US006168130B1

(12) United States Patent
Yokogi

(10) Patent No.: US 6,168,130 B1
(45) Date of Patent: Jan. 2, 2001

(54) CYLINDER CABINET

(75) Inventor: Kazuo Yokogi, Hyogo-ken (JP)

(73) Assignee: L'Air Liquide Societe Anonyme pour l'Etude et l'Exploitation des Procedes Georges Claude, Paris (FR)

( * ) Notice: Under 35 U.S.C. 154(b), the term of this patent shall be extended for 0 days.

(21) Appl. No.: 09/208,437

(22) Filed: Dec. 10, 1998

(30) Foreign Application Priority Data

Dec. 25, 1997 (JP) ..... 9-357412

(51) Int. Cl.[7] ..... A47G 29/00
(52) U.S. Cl. ..... 248/694; 248/550; 248/313
(58) Field of Search ..... 248/550, 316.4, 248/694, 316.1, 313

(56) References Cited

U.S. PATENT DOCUMENTS 4,023,761 * 5/1977 Molis ..... 248/313
5,224,287 * 7/1993 Knudsen ..... 43/81
5,354,029 * 10/1994 Ziaylek, Jr. et al. ..... 248/313
5,447,285 * 9/1995 Yokogi ..... 251/27
5,588,637 * 12/1996 Carsten et al. ..... 251/129.03
5,810,309 * 9/1998 Augustine et al. ..... 248/313
5,899,225 * 5/1999 Yokogi ..... 137/551

* cited by examiner

*Primary Examiner*—Anita M. King
*Assistant Examiner*—Kimberly Wood
(74) *Attorney, Agent, or Firm*—Burns, Doane, Swecker & Mathis, L.L.P.

(57) ABSTRACT

The present invention provides a means for preventing, in a cylinder cabinet, the improper securing of a gas container due to human error or the like. The cylinder cabinet comprises a securing means for securing a gas container therein, a control means for managing and controlling a series of steps for carrying out a gas container-exchange operation, and a detection means for detecting whether the gas container is properly secured. When the detection means detects that the new container is improperly secured, the control means places the gas container-exchange operation on stand-by until the container is properly secured.

5 Claims, 2 Drawing Sheets

CYLINDER CABINET

BACKGROUND OF THE INVENTION

1. Field of the Invention

The present invention relates to a casing in which a gas container is accommodated, hereinafter referred to as a cylinder cabinet. More specifically, the present invention relates to a safety measure involving a means for detecting whether a gas container is firmly fixed in a cylinder cabinet, particulary after said gas container has been exchanged.

2. Description of the Prior Art

Many of the gases used as a feed material in the semiconductor-manufacturing industry, gases such as $SiH_4$, $PH_3$ and $NF_3$, possess various dangerous properties, for instance, combustibility (explosiveness), toxicity and corrosiveness. When such a gas is used it is stored in a portable gas container referred to as a gas bomb or gas cylinder. One is also legally obligated to use a gas container accommodated in a casing referred to as a cylinder cabinet for reasons of safety.

When the amount of gas remaining in a gas container becomes small, the gas container must be exchanged in a timely fashion with a new gas container. In the case where a new gas container is disposed at a predetermined position within a cylinder cabinet, said gas container is usually secured within the cylinder cabinet to prevent it from falling down. As to the means for securing the gas container, particularly to the wall face of a cylinder cabinet, prior art means include a chain or steel band attached to the wall face of the cylinder cabinet for tightening and thereby securing the gas container.

In exchanging a gas container, safety precautions require that there also exist a method for confirming that the exchanged container has been properly secured. However, there is the distinct possibility of human error in such operations. While the release and securing of a gas container are repeatedly carried out whenever a gas container is exchanged, carelessness of the worker can cause the container to be loosely secured, or not secured at all within the cylinder cabinet. Such an error creates a danger that the container will fall down, thereby leading to a gas leak. It would be very desirable and important to the industry, therefore, if a cylinder cabinet was provided which could prevent any failure to properly secure a gas cylinder therein by human error. Safety would be thereby greatly improved.

SUMMARY OF THE INVENTION

In order to achieve the aforementioned objective, the present invention provides a cylinder cabinet having a means for securing a gas container accommodated therein, a control means for managing and controlling a series of steps which are carried out in a gas container-exchange operation, and a detection means which detects whether the gas container is suitably secured or not. When the detection means detects that a new gas container is not properly secured by said securing means after the gas container has been replaced in a gas-exchange operation, the control means places the gas container-exchange operation on standby, not transferring it to the next step.

Therefore, in a case where a worker has forgotten to properly secure a gas container, the cylinder of the present invention does not permit the gas container-exchange operation to progress ahead. As a result, the worker realizes the container must be properly secured and can attend to same.

In a preferred embodiment, the securing means is a band of the type that tightens around and thereby secures the body of a gas container, with a pressure In a preferred embodiment, the securing means is a band of the type that tightens around and thereby secures the body of a gas container, with a pressure sensor attached on the inner face of said band. The pressure sensor can thereby detect whether a suitable tightening force has been applied, and thereby whether the gas container has been properly secured or not.

DETAILED DESCRIPTION OF THE PREFERRED EMBODIMENTS

Figure 1:
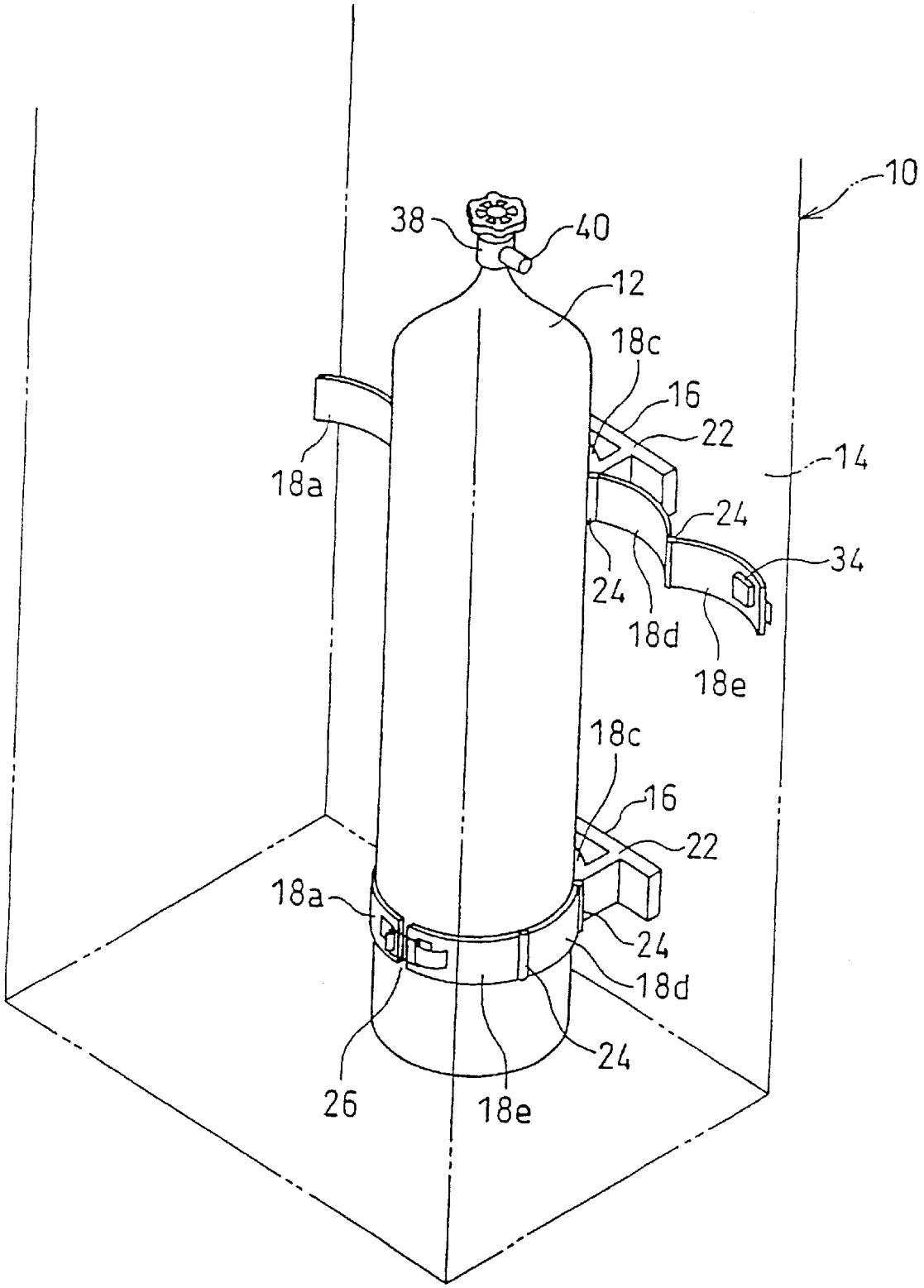
FIG. 1 is a perspective view showing the inside of a cylinder cabinet according to the present invention, and particularly the means for securing a gas container.

In referring to the figures of the drawing, preferred embodiments of the present invention will be described in detail, with the same designation being given to the same or corresponding part.

The reference numerals employed are as follows:

10—cylinder cabinet, 12—gas container, 16—securing band, 26—lock mechanism, 34—pressure sensor, 36—controller.

Figure 2:
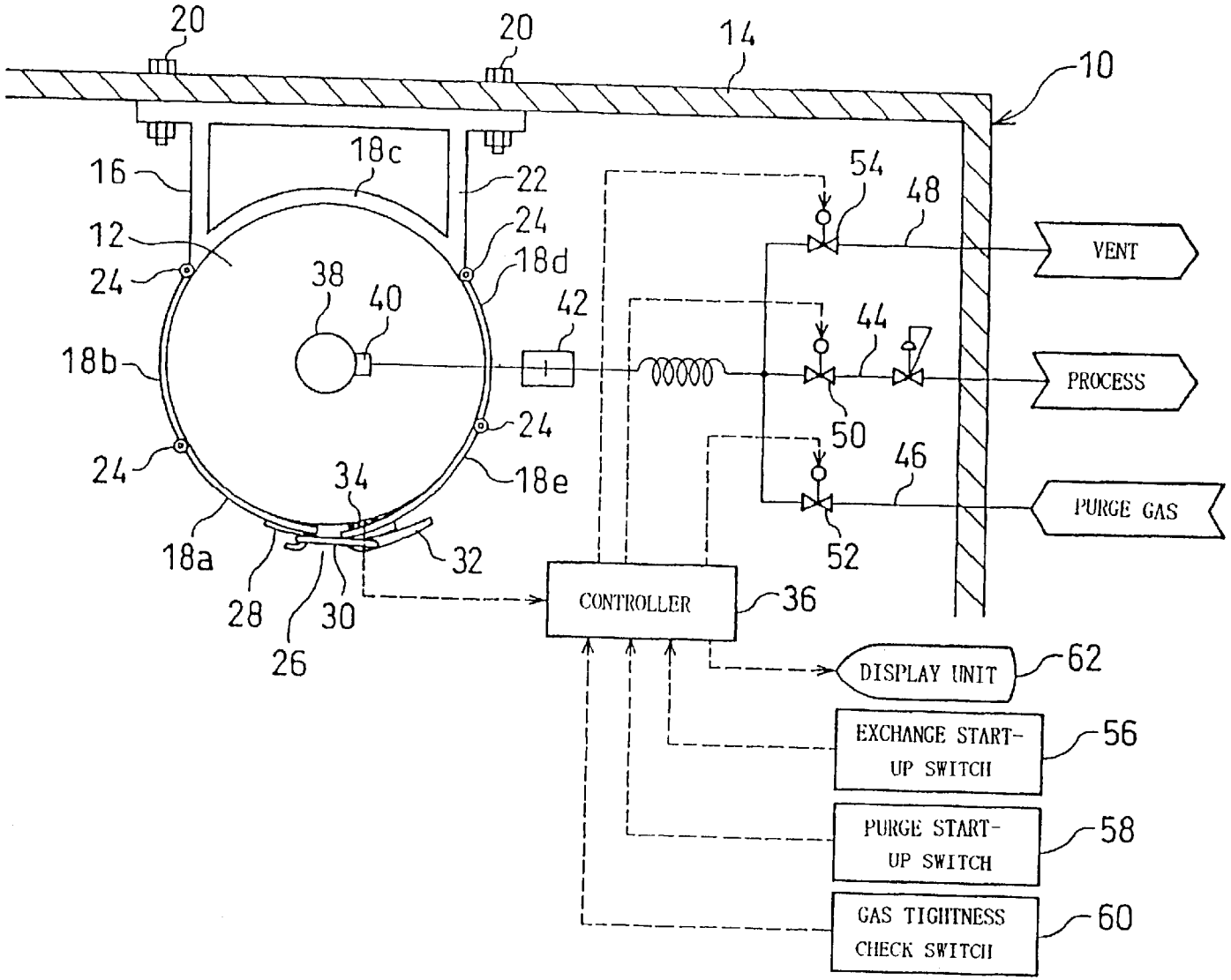
FIG. 2 is a schematic illustrative view showing the construction of a cylinder cabinet according to the present invention.

FIG. 1 and FIG. 2 of the drawing schematically show a cylinder cabinet 10 according to the present invention. In the illustrated embodiment, it is devised that a gas container 12 is secured by steel bands 16 attached on the rear wall face 14 of the cylinder cabinet 10. In order to restrain the upper part and lower part of said gas container 12, a pair of bands 16 are provided high and low. Only one of these high and low securing bands 16 will be described herein because they are of the same structure.

The securing band 16 is one which becomes an annulus surrounding the body of the gas container 12 when the gas container 12 is fixed or secured in place, and it comprises a plurality (i.e. five in the illustrated embodiment) of circular curved portions 18*a*, 18*b*, 18*c*, 18*d* and 18*e*. The curved portion 18*c* is formed integratedly with a bracket 22 attached on the rear wall face 14 of the cylinder cabinet 10 by bolts 20, or the like. This curved portion 18*c* is thicker and is more rigid as compared with the other curved portions, because it must function to receive the gas container 12 carried therein. As to the other curved portions 18*a*, 18*b*, 18*d* and 18*e*, it is preferable that they are relatively thin and exhibit some elasticity to act as a tightening force on the body of the gas container 12.

The curved portions adjacent to each other are mutually connected by a hinge 24, except for the curved portion 18*a* and the curved portion 18*e*. Thus, these curved portions are capable of swinging in a horizontal plane, and hence it becomes possible that a gas container 12 can be placed into the inside of the securing band 16 by opening the curved portions, as can be seen from the band 16 in the upper part of FIG. 1.

Adjacent ends of the curved portions 18*a*, 18*e* will be locked in a closed state by means of a lock mechanism 26. Although various types of mechanisms can be used as the lock mechanism 26, a mechanism of the type illustrated in the drawings is suitable, in which a ring 30 attached on one curved portion 18*e* is clinched onto a hook 28 fixed on the other curved portion 18*a* and said ring 30 is pulled in a toggle manner by a lever 32 so as to be secured on the hook 28. The illustrated securing band 16 is constructed such that a small clearance is provided between the ends of the curved portions 18*a*, 18*e* so that all the curved portions 18 are brought in soft contact with the body of the gas container 12. In a case where the adjacent ends of the curved portions 18*a*, 18*e* are locked by use of the aforementioned lock mechanism 26, the clearance between the curved portions 18*a*, 18*e* gets narrower so that a tightening force is exerted by the securing of band 16 onto the outer peripheral face of the body of the gas container 12, whereby the gas container 12 can be firmly fixed with respect to the cylinder cabinet and further rotation is prevented.

The cylinder cabinet 10 can also have a sensor for detecting whether the ends of the curved portions 18*a*, 18*e* of the band 16 have been closed and locked, thereby detecting whether the gas container 12 has been secured. As such a sensor, many various types of sensors are possible, such as a magnetic or electric access sensor provided between these ends. Generally, however, at least one pressure sensor 34 is preferred which is attached on the inner face of the curved portion 18*e*. When the securing band 16 is locked, this pressure sensor 34 is pressed down between the inner face of the band 16 and the outer peripheral face of the body of the gas container 12, and hence its output signal is changed. Accordingly, it becomes possible to reliably detect whether the gas container 12 has been secured with respect to the cylinder cabinet 10 in fact, without detecting a lock under conditions when a gas container 12 does not exist. An output signal of the pressure sensor 34 will be input to a controller 36 comprising a computer for controlling the whole system of the cylinder cabinet 10, and this controller 36 will manage and control the steps of the exchange operation for the gas container 12 on the basis of this signal.

The gas container 12 secured by the band 16 has a container valve 38 attached on its mouth, and this container valve 38 will be remotely opened or closed by means of an automatic opening and closing apparatus (not shown) which is controlled by the controller 36. The discharge port 40 of said container valve 38 has a gas supply pipe 44 connected thereto detachably by a pipe joint 42. Onto the gas supply pipe 44 are connected two pipes 46, 48 at a position near to said pipe joint 42, where one pipe 46 serves to supply a purge gas such as nitrogen gas from a purge gas supply source and the other pipe 48 serves to vent a gas remaining in the pipe 44 to the atmosphere. Each of the pipes 44, 46, 48 has a shut-off valve 50, 52, 54 provided therein, and the opening and closing operations of these shut-off valves 50, 52, 54 are controlled by the controller 36.

An exchange operation including gas container 12 will next be briefly described.

In a case where the exchange operation of a gas container 12 is begun, a worker first turns on an input device, for example an exchanging work start-up switch 56. The controller 36 receives an input signal from said switch 56, it drives the automatic opening and closing apparatus so that the container valve 38 is closed and at the same time the shut-off valve 50 in the gas supply pipe 44 is closed. In succession, the worker turns on a purge start-up switch 58 to open the shut-off valves 52, 54 in the pipes 46, 48. By virtue of this opening operation, a purge gas is permitted to flow in from a purge gas supply source through the pipe 46, whereby a special material gas existing in the pipe 44 is discharged to the atmosphere through the pipe 48 for vent.

If this purging step is completed prior to the removal of the pipe 44, the controller 36 will release the lock to the door of the cylinder cabinet 10. The worker can not directly contact the gas container 12 until this stage has been reached, and then he separates the pipe joint 42 and removes the pipe 44 from the gas container 12. Thereafter, he releases the lock on the band 16 by its lock mechanism 26, opens the curved portions 18 and carries the gas container 12 out of the cylinder cabinet 10. The worker then carries a new gas container 12 sufficiently filled with a gas into the cylinder cabinet 10, and disposes it at its predetermined position. He then conducts the connection of the pipe joint 42 and the placement of the automatic opening and closing apparatus, and further closes and locks the securing band 16. In the case where the gas container 12 is properly secured at that time, the pressure sensor 34 senses a pressure higher than a predetermined pressure by the tightening force of the securing band 16. On the basis of an output signal from the pressure sensor 34, accordingly, the controller 36 will judge that the gas container 12 has been firmly fixed, and transfer the gas container-exchange operation work to a next gas tightness-checking step.

If a worker, however, has forgotten to conduct the lock of the securing band 16 by its lock mechanism 26, or such locking has been incomplete, the output signal of the pressure sensor 34 does not vary, or even if it has varied, such variation is less than a predetermined level. In such a case, the controller 36 does not transfer the gas container-exchange operation to the next gas tightness-checking step. Even if the worker closes the door of the cylinder cabinet 10 and turns on a gas tightness check start-up switch 60, the gas tightness check will not be conducted and the gas container-exchange operation work will be interrupted and placed on stand-by. Owing to this situation, the worker can recognize that the securing of the gas container 12 is incomplete, and as a result, he is destined to carry out the tightening and securing of the gas container 12 by the securing band 16, with subsequent confirmation again. At that time, the controller 36 may also optionally display in a display unit 62 an indication that the securing of the gas container 12 is incomplete.

If the securing of the gas container 12 has been completed as mentioned above, the gas container-exchange operation will be permitted to progress to the next gas tightness-checking step. Then, a purging step after the attachment of the gas container will be conducted, and as a result, the gas container 12 will be returned to a usual gas supply state.

Although the preferred embodiment of the present invention has been described in detail above, it goes without saying that the present invention is not limited to the aforementioned embodiment. For instance, a series of steps in the gas container-exchanging work mentioned above has been merely exemplified.

For example, although a securing band 16 has been used as the securing means for a gas container 12 in the aforementioned embodiment, there may also be used a securing means of another type, for example, of a chain type. In a case where the securing means is of another type, it is a matter of course that the type of a detection means for detecting the securing of the gas container 12 must be also changed. In a case where a chain is used, for instance, it is necessary to provide a sensor for detecting that a hook provided on one end of said chain is clinched on a fixing ring on the side of a cylinder cabinet, whereby it is enabled to confirm that the securing operation has been completed.

Even when a gas container has not been completely secured in the gas container-exchange operation as described above, according to the present invention, a gas container will be ultimately secured. Accordingly, the present invention is destined to prevent the falling of a gas container which may be caused to happen by the generation of an earthquake or the likes, and to greatly improve the safety of a cylinder cabinet.

What is claimed is:

1. A cylinder cabinet comprises securing means for securing a gas container accommodated therein, a control means for managing and controlling a series of steps which are carried out in a gas container-exchange operation, and a detection means for detecting whether the gas container is secured by said securing means, whereby when said detection means detects that the gas container is not suitably secured by said securing means after the gas container has been placed in a gas container-exchange operation, said control means places the gas container-exchange operation on stand-by.

2. The cylinder cabinet according to claim 1, wherein said securing means is a band that tightens around the body of the gas container, and said detection means is a pressure sensor secured on the inner face of said band.

3. The cylinder cabinet of claim 1, wherein said securing means is a band which tightens around the gas container, the band having two ends which close and lock, and the detection means comprises a magnetic or electric sensor which senses when the ends have been closed and locked.

4. A process for exchanging a gas container in a gas cylinder cabinet, which comprises employing the cylinder cabinet of claim 1.

5. The process of claim 4, wherein the gas container is improperly secured, the control means interrupts the exchange procedure and places it on stand-by until the gas container is properly secured.

* * * * *